US006857167B2

(12) United States Patent
Bishop

(10) Patent No.: US 6,857,167 B2
(45) Date of Patent: Feb. 22, 2005

(54) NECKTIE RESTRAINING DEVICE

(76) Inventor: Donald Gene Bishop, 4208 Crestover Dr., Mesquite, TX (US) 75150

( * ) Notice: Subject to any disclaimer, the term of this patent is extended or adjusted under 35 U.S.C. 154(b) by 0 days.

(21) Appl. No.: 10/615,220

(22) Filed: Jul. 7, 2003

(65) Prior Publication Data

US 2004/0006849 A1 Jan. 15, 2004

Related U.S. Application Data

(60) Provisional application No. 60/395,284, filed on Jul. 12, 2002.

(51) Int. Cl.[7] ..... A45F 5/08

(52) U.S. Cl. ..... 24/66.2; 24/113 R; 24/113 MP

(58) Field of Search ..... 24/66.2, 66.4, 24/3.4, 56, 58, 61, 64, 113 R, 113 MP, 298, 299, 302

(56) References Cited

U.S. PATENT DOCUMENTS

| | | | | | |
|---|---|---|---|---|---|
| 374,715 | A | * | 12/1887 | Sullivan | 24/299 |
| 3,042,983 | A | * | 7/1962 | Riedler | 24/66.2 |
| 3,777,336 | A | * | 12/1973 | Anderson | 24/113 MP |
| 4,554,710 | A | | 11/1985 | Grant | 24/49 |
| 4,972,523 | A | | 11/1990 | Begg | 2/145 |
| 5,031,284 | A | | 7/1991 | Ray | 24/49 |
| 5,095,546 | A | | 3/1992 | Jones | 2/145 |
| 5,109,547 | A | | 5/1992 | Abdallah | 2/145 |
| 5,216,785 | A | * | 6/1993 | Graef | 24/66.2 |
| 5,235,730 | A | | 8/1993 | Townsend | 24/49 |
| 5,245,708 | A | * | 9/1993 | Campelia et al. | 24/66.2 |
| 5,337,457 | A | | 8/1994 | Chennault | 24/49 |
| 5,337,584 | A | * | 8/1994 | Angeli | 24/113 R |
| 5,353,438 | A | | 10/1994 | Voiles | 2/145 |
| 5,526,551 | A | | 6/1996 | Herman | 24/113 |
| 5,621,951 | A | * | 4/1997 | Gould | 24/113 R |
| 5,715,538 | A | | 2/1998 | Soll | 2/145 |
| 5,813,053 | A | | 9/1998 | Pileggi | 2/145 |
| 5,926,923 | A | | 7/1999 | Smith | 24/66.2 |
| 6,163,933 | A | | 12/2000 | Smith | 24/66.2 |
| 6,502,284 | B2 | * | 1/2003 | Juda et al. | 24/7 |

* cited by examiner

*Primary Examiner*—Robert J. Sandy
(74) *Attorney, Agent, or Firm*—Rudolf O. Siegesmund

(57) ABSTRACT

A necktie restraining device is disclosed having two flexibly connected covers. The first cover is placed on the shirt button located above the necktie label on a necktie panel. The second cover and flexible connector are dropped through the opening between the necktie label and the front necktie panel. The second button cover is then placed on the shirt button located below the necktie label.

31 Claims, 2 Drawing Sheets

NECKTIE RESTRAINING DEVICE

RELATED APPLICATIONS

This application claims priority from Provisional Application No. 60/395,284, filed Jul. 12, 2002.

FIELD OF THE INVENTION

The invention is in the field of apparel devices and specifically in the field of neck tie restraining devices for engaging a necktie using the necktie label and two shirt buttons positioned above and below the necktie label.

BACKGROUND OF THE INVENTION

"Four-in-hand" neckties enhance the business appearance of an individual, and may be quite expensive. A "four-in-hand necktie" is placed around the wearer's neck and then tied in one of a variety of knots, resulting in a wide front panel and a narrow back panel hanging down the front of the wearer's shirt. When wearing a loose hanging necktie around mechanical devices, such as motor vehicle engine compartments and copying machines, a risk arises of the loose hanging necktie getting caught in the mechanical device. Additionally, a wearer must exercise care when eating so that a loose hanging necktie does not become soiled by accidental contact with food and/or drink. Another concern of a person wearing a necktie is the look of disarray and the non-businesslike presentation caused by an unrestrained necktie being blown about on a windy day.

An array of necktie control devices have been tried over the years, to include tie tacks, tie bars, tie clips, and plastic, covert tie restraints. These prior art devices have proven unsatisfactory for a variety of reasons. Some have resulted in holes in the necktie, or other damage to the necktie fabric. Some do not permit sufficient movement or play in the panels of the necktie. Some are constructed of multiple small pieces that are easily lost. Finally, some prior art devices do not present an appropriate appearance when used in conjunction with the necktie.

Therefore, several needs exist for a necktie control device that would be an improvement over the prior art. One need is for a necktie control device that would be covered by the panels of the necktie. Another need is for a necktie control device that would affix to two shirt buttons, in such a way as to not damage the necktie, the shirt buttons and their thread, or the front of the shirt. More specifically, a need exists for a necktie control device that would affix to the shirt buttons above and below the necktie label on the back of the front necktie panel. An additional need is for a necktie control device that would allow for sufficient movement of the necktie so as not to affect its normal appearance, yet restrain the movement of the necktie sufficiently to prevent the necktie from getting soiled, damaged, or caught in equipment or machinery. A further, need exists for a necktie control device with sufficient restraint to prevent the necktie from being blown about the wearer on a windy day. A need exists for a necktie control device that can be constructed of material that will permit utility of the device for a reasonable period of time. Finally, it would be desirable for a necktie control device to be adapted for placement of a variety of designs or artwork on the face or faces so as to make it more attractive, fashionable, and contemporary.

United States patents that have been issued in this area fall into three categories. The first category is for devices that require an attachment to the necktie itself. U.S. Pat. No. 4,554,710 discloses a bar for engagement to a shirt button hole attached by a flexible member to a first attachment device. A second attachment device is affixed to the necktie by an adhesive. The first and second attachment devices are adapted for removable engagement with each other. U.S. Pat. No. 4,972,523 discloses a retaining portion affixed to the necktie and a button retaining portion having a button hole for affixing to a button on a wearer's shirt. When the retaining portion and the button retaining portion are placed in contact they are removably engaged to each other. U.S. Pat. No. 5,095,546 discloses a longitudinal member attached to a necktie and a sliding transverse member with a buttonhole for attachment to a shirt. U.S. Pat. No. 5,109,547 discloses a base member affixed to the necktie and a button attachment member having a plurality of holes for receiving a shirt button. The button attachment member is sliding engaged to the base member. U.S. Pat. No. 5,715,538 discloses a first clip for attachment to the tail of a necktie and a second clip for attachment to the overlapping edge of a shirt front. The first clip and the second clip each have a joining surface for removable engagement with each other. U.S. Pat. No. 5,813,053 discloses a tie restraint apparatus comprising a vertical member constructed from the same material as the necktie and bonded to the necktie using a "fusion cloth." A adjustable horizontal member is attached to the vertical member and has a plurality of holes for attaching the horizontal member to a button on a wearer's shirt. The adjustable horizontal member slides up and down the vertical member. U.S. Pat. Nos. 6,926,923 and 5,926,923 disclose a retaining clip adapted for attachment to a shirt button and a fastener affixed to the tie. The fastener has an eyelet for removable engagement with a vertical prong on the retaining clip.

The second category is for devices that may damage the necktie. U.S. Pat. No. 5,031,284 discloses a bar connected by a chain to a retaining device. The retaining device has pointed tips for penetrating the rear fold members of the necktie. U.S. Pat. No. 5,235,730 discloses a holding device connected to a cross bar by a chain or other flexible device. The crossbar inserts into buttonhole of the wearer's shirt and the holding device is formed to provide a clamp for engagement with the rear fold of the wide panel of a necktie.

The third category is for devices that neither attach to the necktie nor are constructed in a way that may damage the necktie. U.S. Pat. No. 5,337,457 (the '457 patent) discloses a one piece device for passing through the loop formed by the necktie label. The device has an attachment member at each end with a slot to receive and retain the threads which hold a button on the shirt. U.S. Pat. No. 5,353,438 (the '438 patent) discloses a one piece device comprising a longitudinal strip of flexible material with a button hole on one end and a circular hole on the other. The device is adapted to form a loop around the necktie label and affix to a button on the wearer's shirt.

The third category discussed above solves a number of the needs identified; however, the '457 patent does not address the problem of using the device when the necktie label is positioned over a shirt button. Moreover, neither the '457 patent nor the '438 patent provide a flat surface for affixing artwork. Such a surface would be desirable in order to improve the overall appearance and utility of a necktie restraining device.

In order to find a device that would meet all of the needs identified above, a variety of pre-existing components were considered such as metallic button covers, plastic one-piece button covers and a variety of plastic or metal chains of varying design and thickness. In considering adaptation of pre-existing components, ease of operation, durability and adaptation for presentation of artwork or design were considered. In regard to placement of artwork or designs on the necktie restraining device U.S. Pat. No. 5,526,551 discloses snap on ornamental assemblies comprising a cap that can snap on to a base member.

SUMMARY OF THE INVENTION

The necktie control device that meets the needs identified above comprises two hinged button covers attached to a length of chain. The chain length is between approximately three and one-half inches and approximately four inches. The chain affixes to the two button covers using two snap rings. To use the invention, the wearer puts on a necktie in the usual manner. The upper button cover is placed on the shirt button located above the necktie label on back of the front necktie panel. The lower button cover and chain are dropped through the opening between the necktie label and the front necktie panel. The lower button cover is then placed on the first shirt button below the necktie label.

DESCRIPTION OF THE PREFERRED EMBODIMENT

Figure 1:
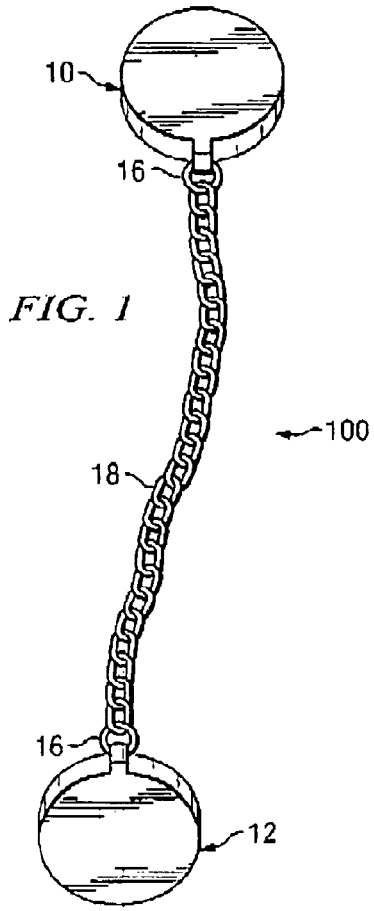
FIG. 1. A frontal view of the necktie control device.

FIG. 1 depicts a frontal perspective of necktie control device 100. Necktie control device 100 has first button cover 10 and second button cover 12 connected by chain 18 having two connecting rings 16, one at each end of chain 18. First button cover 10 and second button cover 12 are of identical construction. In the preferred embodiment, all components may be gold or silver-plated.

Figure 2:
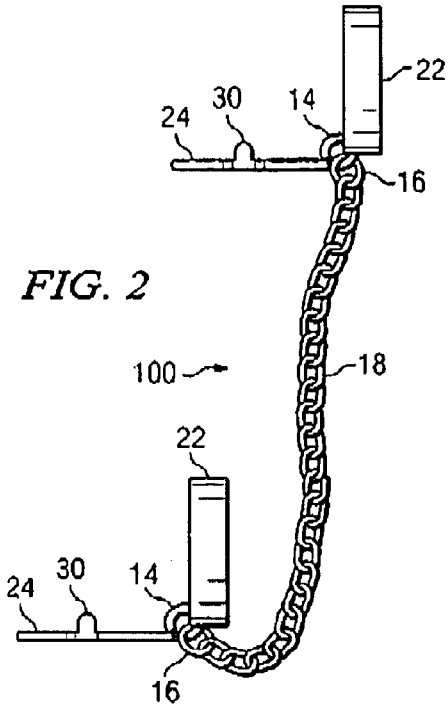
FIG. 2. A side view of the necktie control device.

FIG. 2 is a side view of necktie control device 100, with front 22 of first button cover 10 and front 22 of second button cover 12 in an open vertical position, and back 24 of first button cover and back 24 of second button cover opened and in a horizontal position. Each first button cover 10 and second button cover 12 have front 22 rotatably connected to back 24 by hinge 14 allowing front 22 to be opened substantially in relation to back 24.

Each connecting ring 16 of chain 18 is connected to one of the hinges 14 so that chain 18 extends between and flexibly joins first cover 10 to second cover 12. In the preferred embodiment, the length of chain 18 is in the range of approximately three and one half to four inches which provides for sufficient movement of necktie panels 20 (See FIG. 4) and also to allow necktie retraining device 100 to be used should the necktie be knotted in such a way as to position label 28 directly over the shirt buttons upon which first cover 10 and second cover 12 are placed. When label 28 is positioned directly over a shirt button, the flexibility of chain 18 and the three and one half to four inch length allows necktie restraining device 100 to be used without the need for the user to undo and retie the necktie in order to reposition label 28. Moreover, the length and flexibility of chain 18 is a distinct improvement over the one piece device disclosed in the '457 because the '457 patent device cannot be used when a necktie label such as label 28 is positioned over a button of the wearer's shirt. Persons skilled in the art are aware of alternative devices for connecting first button cover 10 and second button cover 12.

Figure 3:
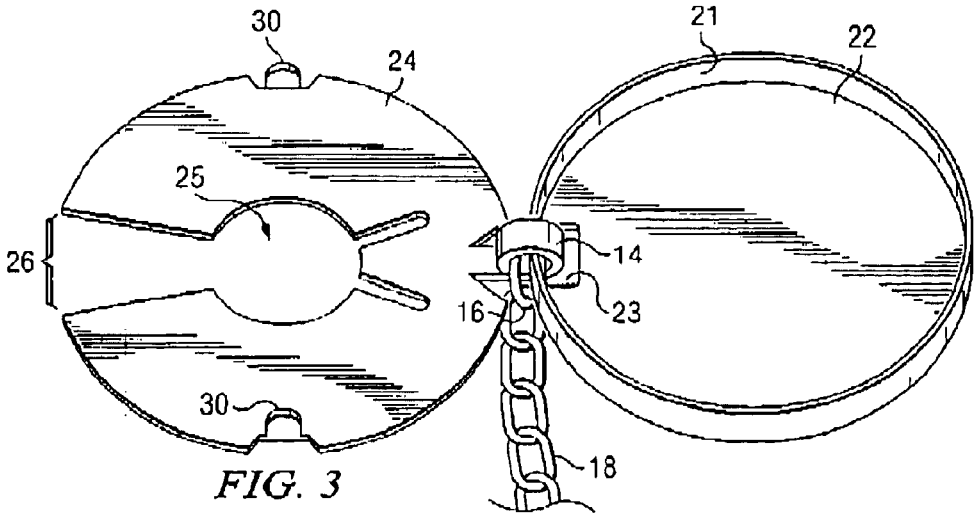
FIG. 3 An enlarged view of a button cover, snap ring, hinge, and chain.

FIG. 3 depicts a detailed view of one of the identical first button covers 10 and second button covers 12 in a completely open position showing the inside area of front 22 and back 24.

Back 24 has slot 26 that allows placement of back 24 around a shirt button. Slot 26 is adapted to permit back 24 to be placed under a shirt button and around the thread that holds the button to the shirt. Slot 26 begins at the outer circumference of back 24 and narrows as it approaches the center of back 24. Circular opening 25 is centrally located in back 24 and slot 26 joins circular opening 25 so that the thread or threads that hold the button to the shirt can be guided into circular opening 25. The thread or threads that hold the button to the shirt may compress slightly as they pass along the narrowing slot 26 and then expand when they enter circular opening 25. Back 24 has a pair of identical and diametrically opposed posts 30 fixedly engaged to back 24.

Front 22 has aperture 23 for receiving hinge 14 of back 24. When hinge 14 is formed front 22 and back 24 are joined. Hinge 14 is formed as follows. An extrusion of back 24 is placed through aperture 23 on front 22, and then bent to create hinge 14. More particularly, hinge 14 is formed from a single flat piece of metal from which back 24 is cut. Hinge 14 initially extends outward from back 24 as a longitudinal flat bar. The longitudinal flat bar is inserted into aperture 23 of front 22 and is then bent upward and over in a circular manner to form a circular opening engaging aperture 23 and forming hinge 14.

Posts 30 are also formed from the single flat piece of metal from which back 24 is cut. Post 30 are initial short flat bars with rounded ends extending outwardly from diametrically opposed edges of back 24. The short flat bars are bent upward at an approximate ninety degree angle to back 24 to form posts 30. Front 22 can be closed over back 24 and held closed by pressure from posts 30. When front 22 is closed over the button, snapping onto back 24, front 22 presents a flat, circular front upon which artwork such as designs or logos may be printed or screened. In addition, rim 21 of front 22 surrounds the button in a full 360 degree circle. Because rim 21 surrounds the button in a full 360 degree circle, first cover 10 and second cover 12 cannot come loose from the buttons they enclose unless front 22 is disengaged from back 24 and opened substantially. The ability of first cover 10 and second cover 12 to enclose the shirt buttons to which they are affixed is an improvement over the one piece device disclosed in the '457 patent for at least three reasons. First, the enclosure provides for a more durable attachment when used repeatedly. Second, the enclosure cannot come loose from the button during movement by the wearer so long as front 22 and back 24 remain engaged by posts 30. Third, the enclosure provides a flat, circular front upon which artwork such as designs or logos may be printed or screened which is a utility possessed by none of the prior art patents including the '457 patent. The ability to display artwork on the flat, circular front makes necktie restraining device 100 adaptable for gifts and advertising.

Ring 16 is opened, placed through the end link of chain 18, and around hinge 14 of back 24, and then closed to secure chain 18 to first button cover 10 and second button cover 12. Use of ring 16 is critical in that it allows both attachment to chain 18 and also permits hinge 14 to open completely.

Chain 18 is affixed to first button cover 10 by ring 16. One ring 16 is affixed to each end of chain 18. Each ring 16 affixed to an end of chain 18 is also affixed to hinge 14 of back 24 of first cover 10 or second cover 12. In order to affix ring 16 to chain 18, ring 16 is opened slightly and placed through the last loop on the end of chain 18. Ring 16 is then placed around the small neck on back 24 near where it is hinged to the front 22. Ring 16 is then closed, securing the chain 18 to first button cover 10. At the opposite end of the chain 18, another ring 16 is affixed to second button cover 12 in the same manner. An alternative method of attaching chain 18 to first button cover 10 and second button cover 12 is by spot-welding.

Figure 4:
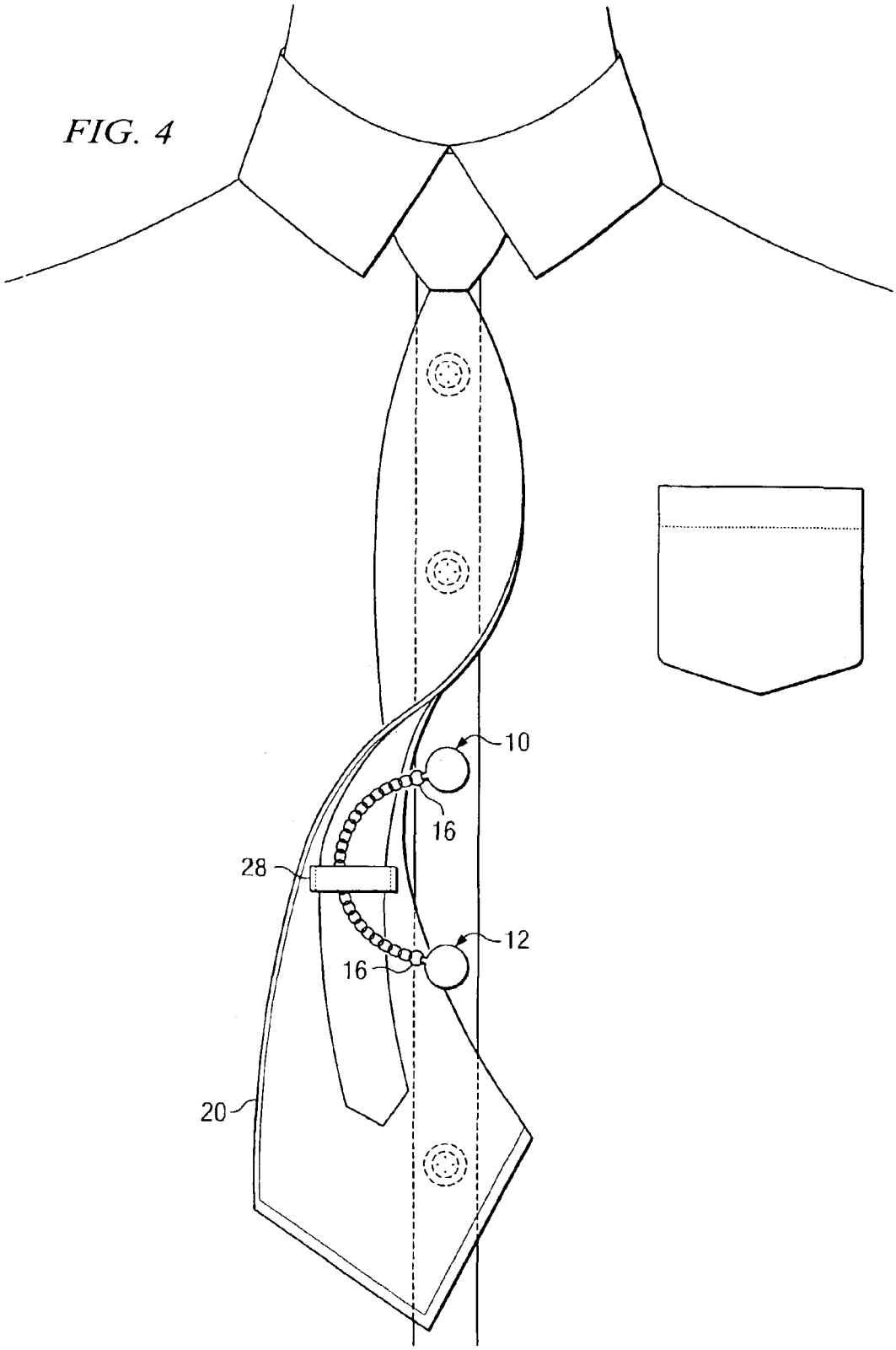
FIG. 4. A depiction of how the necktie control device affixes to the shirt buttons on the wearer's shirt.

FIG. 4 illustrates how necktie control device 100 affixes to the shirt buttons above and below necktie label 28 located on the back of necktie front panel 20. For illustration purposes, the lower half of necktie panel 20 has been turned around to show how chain 18 passes between necktie label 28 and necktie front panel 20. To use necktie restraining device 100, a wearer puts on a necktie in the usual manner. The wearer then locates the shirt button above necktie label 28 on the back of necktie front panel 20. First button cover 10 is opened and back 24 is placed behind the shirt button using slot 26. Front 22 is then snapped closed over the shirt button and back 24, and held closed by posts 30. Chain 18 and the second button cover 12 are then placed through label 28 on the back of the necktie front panel 20. Second button cover 12 is then opened, and the shirt button below the necktie label 28 is placed in slot 26 of back 24 of second button cover 12. Front 22 is then snapped shut and is held in place by posts 30 on back 24. Removal of the necktie restraining device may be accomplished by reversing the steps described above.

The wearer is afforded a necktie control device that does not damage the necktie fabric, provides sufficient mobility of the necktie panels, and controls the necktie under a wide variety of indoor and outdoor conditions. It also presents a new and refreshing fashion look. Additionally, the surfaces of the button covers allow the use of a limitless amount of logo or artwork presentation to further enhance its appearance.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. The novel spirit of the present invention is still embodied by reordering or deleting some of the steps contained in this disclosure. The spirit of the invention is not meant to be limited in any way except by proper construction of the following claims.

What is claimed:

1. A necktie control device for use with a shirt having a plurality of shirt buttons and a necktie having a necktie label comprising:

a first cover adapted for engagement to a first group of threads affixing a first one of the plurality of shirt buttons to the shirt and enclosure of at least one side and a circumferential edge of the first one of the plurality of shirt buttons;

a second cover adapted for engagement to a second group of threads affixing a second one of the plurality of shirt buttons to the shirt and enclosure of at least one side and a circumferential edge of the second one of the plurality of shirt buttons;

a flexible connector engaged to the first cover and the second cover; and wherein the first cover or the second cover is adapted for passage between the necktie label and the necktie.

2. The necktie control device of claim 1 wherein a first front of the first cover is hingedly connected to a first back.

3. The necktie control device of claim 1 wherein a second front of the first cover is hingedly connected to a second back.

4. The necktie control device of claim 2 where the first back further comprising a slot adapted for passage of the group of threads affixing the first one of the plurality of shirt buttons to the shirt.

5. The necktie control device of claim 3 where the second back further comprising a slot adapted for passage of the group of threads affixing the second one of the plurality of shirt buttons to the shirt.

6. The necktie control device of claim 1 wherein the connector comprises a chain.

7. The necktie control device of claim 6 where the chain further comprising a first end and a second end wherein the first end is connected to the first cover by a first ring and the second end is connected to the second cover by a second ring.

8. The necktie control device of claim 2 where the first front further comprising a first flat circular top area adapted for placement of an artwork.

9. The necktie control device of claim 3 where the second front further comprising a second flat circular top area adapted for placement of an artwork.

10. The necktie control device of claim 1 where the first cover and the second cover are identical.

11. The necktie control device of claim 1 wherein the length of the connector is in the range of approximately 3½ inches to 4 inches.

12. The necktie control device of claim 2 wherein the first front is engaged by a plurality of first posts when first cover is in a closed position.

13. The necktie control device of claim 3 wherein the second front is engaged by a plurality of second posts.

14. The necktie control device of claim 2 where the first back further comprising a first hinge that is of unitary construction with the first back.

15. The necktie control device of claim 3 where the second back further comprising a second hinge that is of unitary construction with the second back.

16. A necktie control device for use with a shirt having a plurality of shirt buttons and a necktie having a necktie label comprising:

a first cover adapted for engagement to a first group of threads affixing a first one of the plurality of shirt buttons to the shirt and enclosure of at least one side and a circumferential edge of a first one of the plurality of shirt buttons;

a second cover adapted for engagement to a second group of threads affixing a second one of the plurality of shirt buttons to the shirt and enclosure of at least one side and a circumferential edge of a second one of the plurality of shirt buttons;

a flexible connector engaged to the first cover and the second cover; and wherein the first cover or the second cover is adapted for passage between the necktie label and the necktie;

wherein the first cover comprises a first front hingedly connected to a first back;

wherein the second cover comprises a second front hingedly connected to a second back;

wherein the first back comprises a first slot and a first opening wherein the slot is adapted for passage of a first group of threads for affixing the first one of the plurality of shirt buttons to the shirt and the first opening is adapted for receiving the first group of threads; and wherein the second back comprises a second slot and a second opening wherein the second slot is adapted for passage of a second group of threads for affixing the second one of the plurality of shirt buttons to the shirt and the second slot is adapted for receiving the second group of threads.

17. The necktie control device of claim 16 wherein the connector comprises a chain.

18. The necktie control device of claim 17 where the chain further comprising a first end and a second end wherein the first end is connected to the first cover by a first ring and the second end is connected to the second cover by a second ring.

19. The necktie control device of claim 16 where the first front further comprising a first flat circular top area adapted for placement of an artwork.

20. The necktie control device of claim 16 where the second front further comprising a second flat circular top area adapted for placement of an artwork.

21. The necktie control device of claim 16 where the first cover and the second cover are identical.

22. The necktie control device of claim 16 wherein the length of the connector is in the range of approximately 3½ inches to 4 inches.

23. The necktie control device of claim 16 wherein the first front and the first back are engaged by a plurality of first posts.

24. The necktie control device of claim 16 wherein the second front and the second back are engaged by a plurality of second posts.

25. The necktie control device of claim 16 where the first back further comprising a first hinge that is of unitary construction with the first back.

26. The necktie control device of claim 16 where the first back further comprising a second hinge that is of unitary construction with the second back.

27. A necktie control device for use with a shirt having a plurality of shirt buttons and a necktie having a necktie label comprising:

a first cover adapted for engagement to a first group of threads affixing a first one of the plurality of shirt buttons to the shirt and enclosure of at least one side and a circumferential edge of a first one of the plurality of shirt buttons;

a second cover adapted for engagement to a second group of threads affixing a second one of the plurality of shirt buttons to the shirt and enclosure of at least one side and a circumferential edge of a second one at the plurality of shirt buttons;

a flexible connector engaged to the first cover and the second cover; and wherein the first cover or the second cover is adapted for passage between the necktie label and the necktie;

wherein the first cover comprises a first front hingedly connected to a first back;

wherein the second cover comprises a second front hingedly connected to a second back;

wherein the first back comprises a first slot and a first opening wherein the first slot is adapted for passage of a first group of threads for affixing the first one of the plurality of shirt buttons to the shirt and the first opening is adapted for receiving the first group of threads;

wherein the second back comprises a second slot and a second opening wherein the second slot is adapted for passage of a second group of threads affixing the second one of the plurality of shirt buttons to the shirt;

wherein the flexible connector comprises a first end and a second end;

wherein the first end is connected to the first cover by a first ring and the second end is connected to the second cover by a second ring;

wherein the first front further comprises a first flat circular top area adapted for placement of an artwork;

wherein the second front further comprises a second flat circular top area adapted for placement of art artwork;

wherein the first front and the first back may be engaged by a plurality of first posts;

wherein the second front and the second back may be engaged by a plurality at second posts;

wherein the first back comprises a first hinge that is of unitary construction with the first back; and wherein the second back comprises a second hinge that is of unitary construction with the second back.

28. The necktie control device of claim 27 wherein the first cover and the second cover are identical.

29. The necktie control device of claim 27 wherein the length of the connector is in the range of approximately 3½ inches to 4 inches.

30. The necktie control device of claim 27 wherein the connector comprises a chain.

31. A necktie control device comprising a set of two covers adapted for covering at least one side and a circumferential edge of each of two shirt buttons and also engaging each of a group of threads affixing each of the two shirt buttons to a shirt wherein the two covers are flexibly connected.

* * * * *

UNITED STATES PATENT AND TRADEMARK OFFICE

CERTIFICATE OF CORRECTION

PATENT NO. : 6,857,167 B2
DATED : February 25, 2005
INVENTOR(S) : Bishop

It is certified that error appears in the above-identified patent and that said Letters Patent is hereby corrected as shown below:

Column 7,
Line 34, "first" should be -- second --

Signed and Sealed this

Thrid Day of May, 2005

JON W. DUDAS
*Director of the United States Patent and Trademark Office*